United States Patent [19]

Sasaki et al.

[11] Patent Number: 4,773,559

[45] Date of Patent: Sep. 27, 1988

[54] CONTAINER FOR ORGANISM SAMPLE

[75] Inventors: Masahide Sasaki, Kochi; Shinichiro Matsuda, Shiga, both of Japan

[73] Assignee: Nissho Corporation, Osaka, Japan

[21] Appl. No.: 63,036

[22] Filed: Jun. 17, 1987

[30] Foreign Application Priority Data

Jun. 24, 1986 [JP] Japan ..... 61-147731
Jun. 24, 1986 [JP] Japan ..... 61-96521[U]

[51] Int. Cl.[4] ..... B65D 43/06

[52] U.S. Cl. ..... 220/355; 220/375; 150/55

[58] Field of Search ..... 220/375, 355, 356; 150/55

[56] References Cited

U.S. PATENT DOCUMENTS 2,958,439 11/1960 Yochem ..... 220/375
3,297,192 1/1967 Swett ..... 220/355
4,390,111 6/1983 Robbins et al. ..... 220/375

*Primary Examiner*—George T. Hall
*Attorney, Agent, or Firm*—Armstrong, Nikaido, Marmelstein & Kubovcik

[57] ABSTRACT

A container for organism sample made of soft thermoplastic synthetic resin having a cylindrical body with a bottom and a cap whch is airtightly put on a mouth of the body. The cap has a cap portion to cover the mouth and a stopper portion to be inserted into the mouth. The cap cannot come off from the body by virtue of the above double-engagement-construction. In the second invention, a container further has a plurality of annular ribs provided at an outer wall of a body portion of the body near the mouth. Thus, the container can be used as a plug for a test tube and the like and there can be avoided a trouble of taking the wrong container.

6 Claims, 2 Drawing Sheets

CONTAINER FOR ORGANISM SAMPLE

BACKGROUND OF THE INVENTION

The present invention relates to a container for organism sample and more particularly to a small-sized tubular container for organism sample having a cap (hereinafter referred to as "minispitz") for containing, inspecting and/or preserving an organism sample such as blood and urine, which is particularly suitable for refrigeration storage of blood serum for a long period of time.

Hitherto, there have been carried out biochemical inspections such as inspections of blood sugar to diagnose diabetes, when diagnosing disease of viscera such as liver, kidney, and pancreas. In such biochemical inspections, containers for organism sample are used to inspect organism sample, to centrifuge the organism sample prior to the inspection, and to preserve the organism sample till the inspection. Test tubes, Petri dishes, and the like are used as containers for organism sample. Among them, test tubes for collecting, preserving, centrifuging, and the like are widely used in various kinds of examinations or inspections.

Among the above-mentioned various kinds of test tubes, one suitable for the centrifugation treatment is called "spitz". A lower or bottom portion of a spitz is generally formed to have a spired contour. Decantation can be easily carried out when using a spitz because the inside diameter of the open upper end of the spitz (hereinafter referred to as "mouth") is equal to, or slightly larger than the inside diameter of a body portion of the spitz. That is to say, when a fluid sample is contained and centrifuged, a supernatant fluid of the centrifuged sample can be easily poured from the spitz into another container by leaning the spitz.

When using, for example, blood as a sample, a spitz is generally used to contain and centrifuge the blood, and thereafter to pour a supernatant fluid, i.e. blood serum, from the spitz to another container which might be a spitz. A spitz is also used to contain blood corpuscle or blood serum and to inspect or preserve them. In particular, a small-sized spitz having a cap called "minispitz" is widely used for the purpose of preservation.

A conventional minispitz has such a construction that a cap is merely inserted into the inside of a cylindrical body portion of the minispitz. When, for example, blood serum is preserved for a long period of time, the minispitz is sometimes preserved at a ultra-low temperature of minus 80° C. in order to prevent the deterioration of blood serum during the preservation. In that case, there is caused a problem that the cap inserted into the body portion of the minispitz is opened. The reason why the cap is opened is probably that an inside pressure of the minispitz relatively becomes positive during the preservation at a ultra-low temprature of as low as minus 80° C.

Further, when preserving a large number of minispitzes, a wrong sample was often taken due to the small size thereof.

The present invention was made to solve the above-mentioned drawbacks and a first object of the present invention is to provide a minispitz of which cap is not opened even when the minispitz is preserved at a ultra-low temperature. It is a second object of the present invention to further provide a minispitz suitable for a refrigeration storage at a ultra-low temperature, by which there is no danger of taking the wrong minispitz on inspection.

SUMMARY OF THE INVENTION

As a result of vigorous investigation, we inventors have found out that the above first problem (such a problem that a cap is opened during the preservation at a ultra-low temperature) can be solved by employing a so-called double-engagement-construction wherein a cap is put on a mouth portion of a minispitz in such a manner that a cap engages with an inner wall of the mouth portion together with an outer wall thereof, and have completed a first invention. The inventors have also found out that the above second problem (to take the wrong minispitz) can be solved by using a plug-like minispitz which can be airtightly put on a container for organism sample containing the same sample as the minispitz and by preserving the minispitz and the container for organism sample in one body, and have completed a second invention.

That is, in accordance with the present invention, there are provided a container for organism sample (a first invention) made of soft thermoplastic synthetic resin comprising a cylindrical body with a bottom, and an attachable and detachable cap which is airtightly put on a mouth portion of the body, characterized in that the cap comprises a cap portion to cover the mouth portion and a stopper portion to be inserted into the mouth portion, and a container for organism sample (a second invention) made of soft thermoplastic synthetic resin comprising a cylindrical body with a bottom, and an attachable and detachable cap which is airtightly put on a mouth portion of the body, characterized in that the cap comprises a cap portion to cover the mouth portion and a stopper portion to be inserted into the mouth portion; and a plurality of annular ribs are provided at an outer wall of a body portion of the body near the mouth portion, and one of the annular ribs is provided adjacent to the mouth portion.

DETAILED DESCRIPTION

Figure 1:
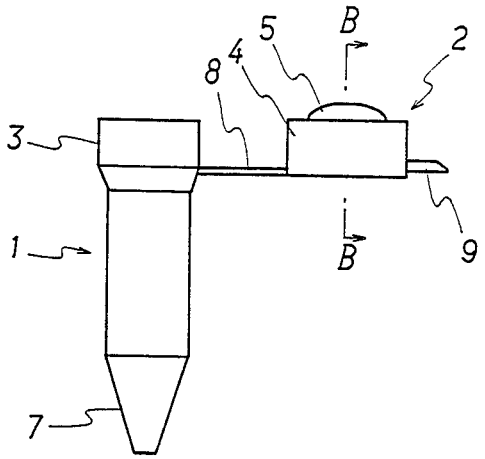
FIG. 1 is a front view of an embodiment of a minispitz of the first invention wherein a cap of the minispitz is open.

Now, there is explained a minispitz of the present invention in detail.

The explanation is made with respect to a case where a minispitz is put into a freezing chamber. An ultra-low temperature freezing chamber of as low as minus 80° C. can be considered to be perfectly airtightly closed in a short time because such ultra-low temperature freezing chamber has superior airtightness. Accordingly, when the temperature outside the freezing chamber is 20° C. and the air pressure is 1 atmosphere, the air pressure in the freezing chamber when the temperature in the freezing chamber is lowered to minus 80° C. is about 0.659 atmosphere of which value can be obtained by means of a calculation based on Charle's law. On the other hand, the temperature inside the minispitz is considered to be still fairly high compared with the temperature inside the freezing chamber even when it is lowered to minus 80° C., because the minispitz is made of synthetic resin and has small thermal conductivity and accordingly is refrigerated slowly compared with the air in the freezing chamber. Assuming that (1) the temperature of the minispitz is minus 20° C., (2) the minispitz is airtightly closed by the cap, and (3) the minispitz does not expand by the relative positive pressure, the air pressure in the minispitz can be calculated based on Charle's law to be about 0.863 atmosphere. The difference of air pressure between the inside of the freezing chamber and that of the minispitz amounts to as much as about 0.204 atmosphere. In fact, such difference is much smaller than the above calculated value, i.e. 0.204 atmosphere, because a little outside air comes into the freezing chamber and the capacity of the minispitz is considered to expand. However, in the event that a cap merely covers a mouth of the minispitz or is inserted into the mouth, the cap is detached from the minispitz during the preservation because a body of the minispitz expands and the engagement between the cap and the body becomes loose due to the relative positive pressure in the minispitz.

On the contrary, the engagement between a cap and a mouth of a minispitz of the first invention does not become loose, because the cap has a so-call double-engagement-construction wherein a cap comprises a cap portion which covers a mouth portion of a body of the minispitz and a stopper portion which is inserted into the mouth portion of the minispitz. Because the minispitz is made of soft thermoplastic synthetic resin, the pressure in the minispitz is probably reduced due to the expantion of a body of the minispitz, and thereby the cap is not opened. The minispitz of the present invention is therefore applicable to a refrigeration storage at a ultra-low temperature of as low as minus 80° C.

A minispitz of the second invention has a plurality of annular ribs provided at an outer wall of a body portion near a mouth portion, one of the annular ribs being provided adjacent to the mouth portion. The minispitz, therefore, can be used as a plug for a container such as a test tube of which inside diameter is slightly larger than the outside diameter of a body portion and is slightly smaller than the outside diameter of the annular ribs. The refrigeration storage can be carried out with the minispitz being put as a plug on an open upper end of the test tube. By using the minispitz of the second invention as a plug for such container, a container can be easily discriminated from another container, and whereby there can be avoided a trouble of taking the wrong container.

Next, there are explained embodiments of the present invention based on the accompanying drawings.

Figure 2:
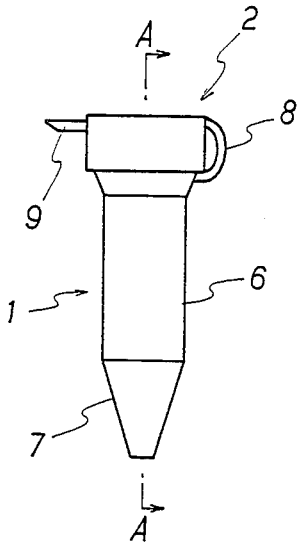
FIG. 2 is a front view of a minispitz of FIG. 1 wherein a cap is put on the minispitz.
Figure 3:
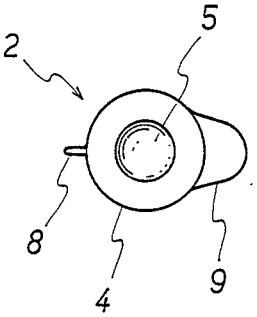
FIG. 3 is a plan view of a minispitz of FIG. 2.
Figure 4:
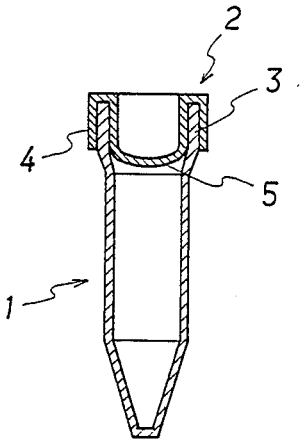
FIG. 4 is an end view taken along the line A—A of FIG. 2.
Figure 5:
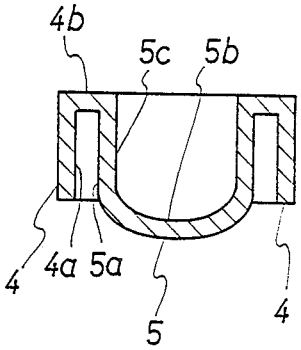
FIG. 5 is an end view taken along the line B—B of FIG. 1.

As shown in FIGS. 1 to 3, a minispitz of the first invention comprises a cylindrical body 1 with a bottom and a cap 2 which is put on the body 1. The minispitz is made of thermoplastic synthetic resin such as polyethylene, ethylene-propylene random copolymer, and butadiene-styrene copolymer. The cap 2 comprises a cap portion 4 to cover a mouth portion 3 and a stopper portion 5 to be inserted into a mouth portion 3 so that the mouth 3 is sandwiched between the cap portion 4 and the stopper portion 5 (see FIGS. 4 and 5).

The clearance between an outer wall 5*a* of the stopper portion 5 and an inner wall 4*a* of the cap portion is designed to slightly smaller than a wall thickness of the mouth portion 3 in order that the cap 2 can be airtightly put on the mouth portion 3. The stopper portion 5 is inserted into the mouth portion 3, and consists of a bottom 5*b* and a sidewall 5*c* which is formed vertical to an upper wall 4*b* and concentric with a sidewall of the cap portion 4. The shape of the stopper portion 5 might be column-like or cylindrical. The stopper portion 5, however, preferably has a U-shaped contour, and is preferably located at a center of the cap 2 and integrally formed with the cap portion 4.

The body 1 is formed to be cylindrical and has a bottom. The inside diameter of a body portion 6 is designed to be larger than that of a bottom portion 7, while the inside diameter of the mouth portion 3 is designed to be equal to or larger than that of the body portion 6. A wall thickness of the mouth portion 3 is preferably larger than that of the body portion 6 in order to withstand a pressure generated when the mouth portion 3 is engaged with the cap 2. Concretely speaking, the wall thickness is preferably two or three times larger than that of the body portion 6. It is convenient that the body 1 and the cap 2 is connected each other by means of a cord-like portion 8 to avoid a loss of the cap 2 and to facilitate the attachment and detachment of the cap 2.

The formation of a projection 9 of appropriate shape can facilitate the detachment of the cap 2.

Next, there is explained an embodiment of a minispitz of the second invention.

Figure 6:
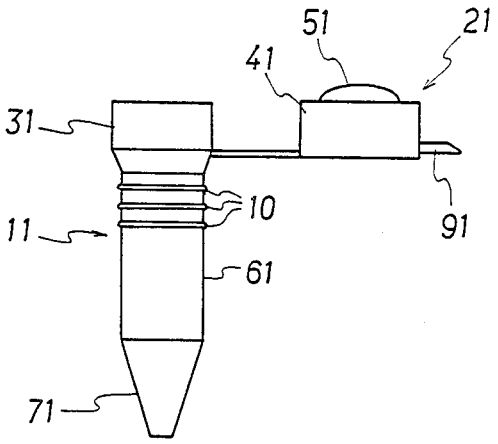
FIG. 6 is a front view of an embodiment of a minispitz of the second invention wherein a cap of the minispitz is open.
Figure 7:
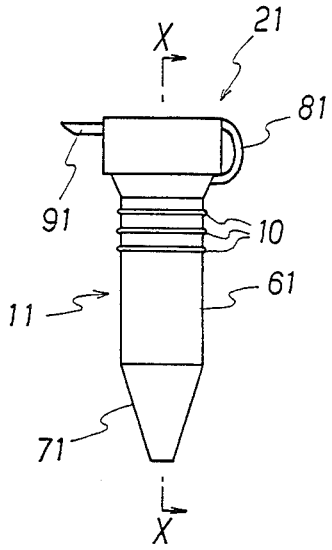
FIG. 7 is a front view of a minispitz of FIG. 6 wherein a cap is put on the minispitz.
Figure 8:
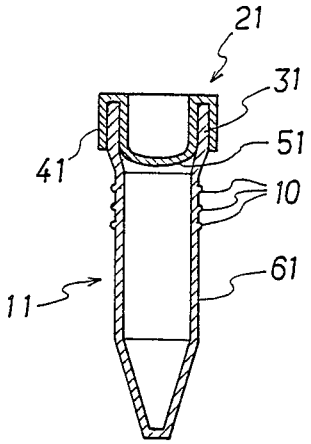
FIG. 8 is an end view taken along the line X—X of FIG. 7.

As shown in FIGS. 6 to 7, a minispitz of the second invention comprises a cylindrical body 11 with a bottom and a cap 21 which is put on the body 11. The minispitz is made of thermoplastic sythetic resin such as polyethylene, ethylene-propylene random copolymer, and butadiene-styrene copolymer. The cap 21 comprises a cap portion 41 to cover a mouth portion 31 and a stopper portion 51 to inserted into a mouth portion 31 so that the mouth 31 is sandwiched between the cap portion 41 and the stopper portion 51. A plurality of annular ribs 10 are provided at an outer wall of a body portion 61 of the body 11 near the mouth portion 31. By means of the annular ribs, the minispitz of the second invention can be preferably used as a plug for a container, during refrigeration storage, such as a test tube of which inside diameter is slightly larger than the outside diameter of the body portion 61 and slightly smaller than the outside diameter of the annular ribs 10. By using the minispitz of the second invention as a plug for such container, a container can be easily discriminated from another container and whereby there can be avoided a trouble of taking the wrong container during the preservation of minispitz. In FIGS. 6 to 7, elements represented by numerals 71, 81, and 91 correspond to those represented by numerals 7, 8, and 9 in FIGS. 1 to 3 respectively.

Figure 9:
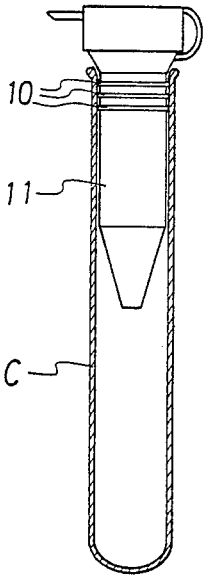
FIG. 9 is a view explaining a state wherein the minispitz of FIG. 7 is used.

When the minispitz of the second invention is put on a test tube C as shown in FIG. 9, the minispitz is airtightly and softly inserted into the test tube by the close engagement between the annular ribs 10 and an inner wall of the test tube C, because the body 11 is made of soft thermoplastic synthetic resin. In that case, too small interval or pitch between ribs sometimes makes the engagement between the body 11 and the test tube C loose because the body 11 is slightly dented at the annular portion 10. The interval between the ribs 10, therefore, is preferably not less than 2 mm. Further, two or three annular ribs 10 can provide a sufficient engagement or contact, so too many ribs are not required.

In the minispitz of the second invention, one of the annular ribs is provided adjacent to the mouth portion 31 of the body 11. The stiffness of the mouth portion 31, which preferably has a thicker wall than the other portion, is by far increased in comparison with that of the body 11 when a cap is put on the mouth portion 31. By providing one of the annular ribs adjacent to the mouth portion 31 having a large stiffness as described above, the engagement of the minispitz with the test tube is ensured, so that the minispitz is prevented from detaching from the test tube during the refrigeration storage due to the relative positive pressure in the test tube.

As is clear from the above explanation, a minispitz of the present invention has the following superior effects.

(1) A cap does not come off from a body of a minispitz, because the whole minispitz is made of soft thermoplastic synthetic resin and the cap comprises a cap portion to cover a mouth portion of the body and a stopper portion to be inserted into the mouth portion.

(2) By virtue of a plurality of annular ribs provided at an outer wall of a body portion near the mouth portion, a minispitz of the present invention can be used as a plug for a container such as test tube in order to prevent the confusion between containers.

(3) In the event that one of the annular ribs is provided adjacent to the mouth portion comprising a thick wall having a large stiffness, there can be avoided the detachment of a minispitz from a container even during refrigeration storage under ultra-low temperature.

A container of the present invention is not limited to so-called "minispitz" of small size. The size of the container can preferably determined according to the use of containers.

It is further understood by those skilled in the art that the foregoing description is a preferred embodiment of the disclosed device and that various changes and modifications may be made in the invention without departing from the spirit and scope thereof.

What is claimed is:

1. A container for organism sample made of soft thermoplastic synthetic resin comprising a cylindrical body with a bottom and a mouth portion, and an attachable and detachable cap which is airtightly put on said mouth portion of the body, the cap comprising a cap portion to cover the mouth portion and a stopper portion to be inserted into the mouth portion, so that said mouth portion is sandwiched between said cap portion and said stopper portion when said cap closes said body.

2. The container of claim 1, wherein the stopper portion has a U-shaped contour, is located at a center of the cap and integrally formed with the cap portion.

3. The container of any one of claims 1 or 2, wherein a wall thickness of the mouth portion of the body is made thicker than the other portion of the body.

4. A container for organism sample made of soft thermoplastic synthetic resin comprising a cylindrical body with a bottom and a mouth portion, and an attachable and detachable cap which is airtightly put on said mouth portion of the body, the cap comprising a cap portion to cover the mouth portion and a stopper portion to be inserted into the mouth portion; said cylindrical body having a plurality of annular ribs provided at an outer wall of a body portion of the body near the mouth portion, one of the annular ribs being provided adjacent to the mouth portion.

5. The container of claim 4, wherein the stopper portion has a U-shaped contour, is located at a center of the cap and integrally formed with the cap portion.

6. The container of any one of claims 4 or 5, wherein a wall thickness of the mouth portion of the body is made thicker than the other portion of the body.

* * * * *